US007567650B2

(12) United States Patent
Harding et al.

(10) Patent No.: US 7,567,650 B2
(45) Date of Patent: Jul. 28, 2009

(54) FLUORESCENT X-RAY SOURCE

(75) Inventors: Geoffrey Harding, Hamburg (DE); Bernd R. David, Heuttblek (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 456 days.

(21) Appl. No.: 10/556,612

(22) PCT Filed: May 12, 2004

(86) PCT No.: PCT/IB2004/050653

§ 371 (c)(1), (2), (4) Date: Nov. 15, 2005

(87) PCT Pub. No.: WO2004/102609

PCT Pub. Date: Nov. 25, 2004

(65) Prior Publication Data

US 2008/0069305 A1 Mar. 20, 2008

(30) Foreign Application Priority Data

May 19, 2003 (EP) ..... 03101401

(51) Int. Cl.
*H01J 35/08* (2006.01)

(52) U.S. Cl. ..... 378/143; 378/44; 378/125

(58) Field of Classification Search ..... 378/124, 378/125, 44, 143
See application file for complete search history.

(56) References Cited

U.S. PATENT DOCUMENTS

| | | | | |
|---|---|---|---|---|
| 4,903,287 | A | 2/1990 | Harding | |
| 5,157,704 | A | 10/1992 | Harding | |
| 6,185,277 | B1 | 2/2001 | Harding | |
| 6,560,313 | B1 * | 5/2003 | Harding et al. | 378/143 |

FOREIGN PATENT DOCUMENTS

JP 2001155670 * 6/2001

* cited by examiner

*Primary Examiner*—Edward J Glick
*Assistant Examiner*—Mona M Sanei

(57) ABSTRACT

The present invention relates to an X-ray source for the generation of fluorescent X-rays. The X-ray source is realized by an electron source for the emission of electrons and a target which emits X-rays in response to the incidence of the electrons, the target comprising a ring-shaped primary target for the emission of primary X-rays in response to the incidence of the electrons and a secondary target for the emission of fluorescent X-rays in response to the incidence of the primary X-rays. To obtain an enhanced radiance, it is proposed that the primary target comprises a liquid metal channel arranged in a radial direction relative to a central axis, and that a liquid metal circulates in the liquid metal channel during operation of the X-ray source in the radial direction from an inner side to an outer side of the ring-shaped primary target.

20 Claims, 3 Drawing Sheets

FLUORESCENT X-RAY SOURCE

The present invention relates to an X-ray source for the generation of fluorescent X-rays comprising an electron source for the emission of electrons and a target which emits X-rays in response to the incidence of the electrons, said target comprising a ring-shaped primary target for the emission of primary X-rays in response to the incidence of the electrons and a secondary target for the emission of fluorescent X-rays in response to the incidence of the primary X-rays.

The invention further relates to an X-ray anode for the emission of fluorescent X-rays in response to the incidence of electrons, said anode comprising a ring-shaped primary target for the emission of primary X-rays in response to the incidence of the electrons and a secondary target for the emission of fluorescent X-rays in response to the incidence of the primary X-rays.

Monochromatic X-ray sources enhance the performance of conventional X-ray techniques and enable innovative ones. Such monochromatic X-ray sources are, for instance, described in U.S. Pat. Nos. 4,903,287 and 5,157,704. The anode, also called primary target, which encloses a member, also called secondary target, is struck by electrons on its side which faces the member and in which the primary X-ray radiation generated in the anode generates fluorescent radiation in the member. The member is preferably arranged within an enclosing shield which keeps scattered electrons remote from the member. This principle is often referred to as Fluorex principle.

The fundamental X-ray interaction cross-sections, such as Compton scattering, photoelectric absorption and coherent X-ray scatter, are all energy-dependent. It has traditionally been assumed in diagnostic radiology that the continuous spectrum emitted by polychromatic radiation sources (electron-impact) can be approximated by a monochromatic line of "average" energy. The beam hardening artifact of computed tomography (CT) is evidence that this approximation must be abandoned when accurate results for the attenuation coefficient are desired.

The "average energy" approximation breaks down even more seriously in novel X-ray techniques such as coherent scatter CT or TEAMFI, which ideally require monochromatic radiation. Such radiation sources are either weak (e.g. radio nuclides) or inconvenient (e.g. synchrotrons).

Another type of monochromatic X-ray source which is based on the so-called LIMAX principle is described in U.S. Pat. No. 6,185,277. In this X-ray source a liquid metal target is provided. The electrons emitted by the electron source enter the liquid metal through a thin window and produce X-rays therein. The liquid metal, having a high atomic number, circulates under the influence of a pump, so that the heat produced by the interaction with the electrons in the window and the liquid metal can be dissipated. The heat generated at this area is dissipated by a turbulent flow, thus ensuring effective cooling.

The prior art includes DE 196 39 241 A1 which relates to a monochromatic X-ray source having an electron emitter, a fluorescent target, and an anode associated with the fluorescent target, whereby an incident surface is provided as a target for primary electrons emerging from the electron emitter, such that radiation emitted therefrom is incident on the fluorescent target.

It is an object of the present invention to provide a quasi-monochromatic X-ray source for the generation of fluorescent X-rays of the kind mentioned in the opening paragraphs, by which an enhanced radiance (defined as photons per unit source area per second per steradian) can be obtained compared to known quasi-monochromatic X-ray sources. Further, an anode for use in such an X-ray source shall be provided.

In order to achieve this object, an X-ray source for the generation of fluorescent X-rays according to the invention and an X-ray anode for the emission of fluorescent X-rays according to the invention are both characterized in that said primary target comprises a liquid metal channel arranged in a radial direction relative to a central axis, a liquid metal circulating in said liquid metal channel during operation of the X-ray source in the radial direction from an inner side to an outer side of said ring-shaped primary target.

The present invention is based on a combination of the Fluorex principle with the liquid metal anode X-ray technique, which permits a large increase in source radiance. To obtain this increased radiance, a radial flow geometry is used in the liquid metal channel. The circular-symmetric geometry of the primary and secondary targets maximizes, for a certain size (i.e. focus dimension) of the secondary target, the mean solid angle, Mean, which the secondary target subtends at the primary target. The radial flow arrangement correspondingly maximizes the power with which the ring-shaped circular-symmetric primary target can be loaded. By the invention, the performance of conventional radiological techniques can be enhanced and novel radiological techniques are enabled to be practically realized.

Preferred embodiments of the invention are defined in the dependent claims. It is, for instance, advantageous that the secondary target is arranged on the central axis of the ring-shaped primary target and is adapted to emit the fluorescent X-rays substantially in directions parallel to said central axis. This arrangement is most effective with respect to efficiency of use of primary X-rays. The fluorescent X-rays will thus be emitted through the central hole of the ring-shaped primary target.

According to another embodiment, the liquid metal channel comprises a constriction in an electron impact zone in which the electrons hit the primary target. This ensures that at an electron window, where the electrons are incident, the pressure on the window is minimized, i.e. the viscous pressure drop across the electron window is balanced by an increase in the Bernoulli pressure.

According to another aspect, the surface of the primary target facing the electron source is covered by a metal membrane, for instance a foil. This membrane serves for separating the vacuum region of the X-ray source from the liquid metal channel behind the membrane.

The liquid metal circulating in the liquid metal channel preferably comprises a material having a high atomic number to ensure that sufficient X-rays are generated therein upon incidence of the electrons. Preferably, the liquid metal has an atomic number larger than 40 and smaller than 80. For instance, the liquid metal may comprise an alloy of Bi, Pb, In or Sn.

To ensure a strict radial flow of the liquid metal in the liquid metal channel, radial fins are further provided to divide the liquid metal channel into a number of radial sub-channels. Thus, the liquid metal can only flow in radial direction but not in circular direction, i.e. in a direction around the central axis.

Embodiments of the present invention will now be explained in more detail with reference to the drawings, in which.

Figure 1:
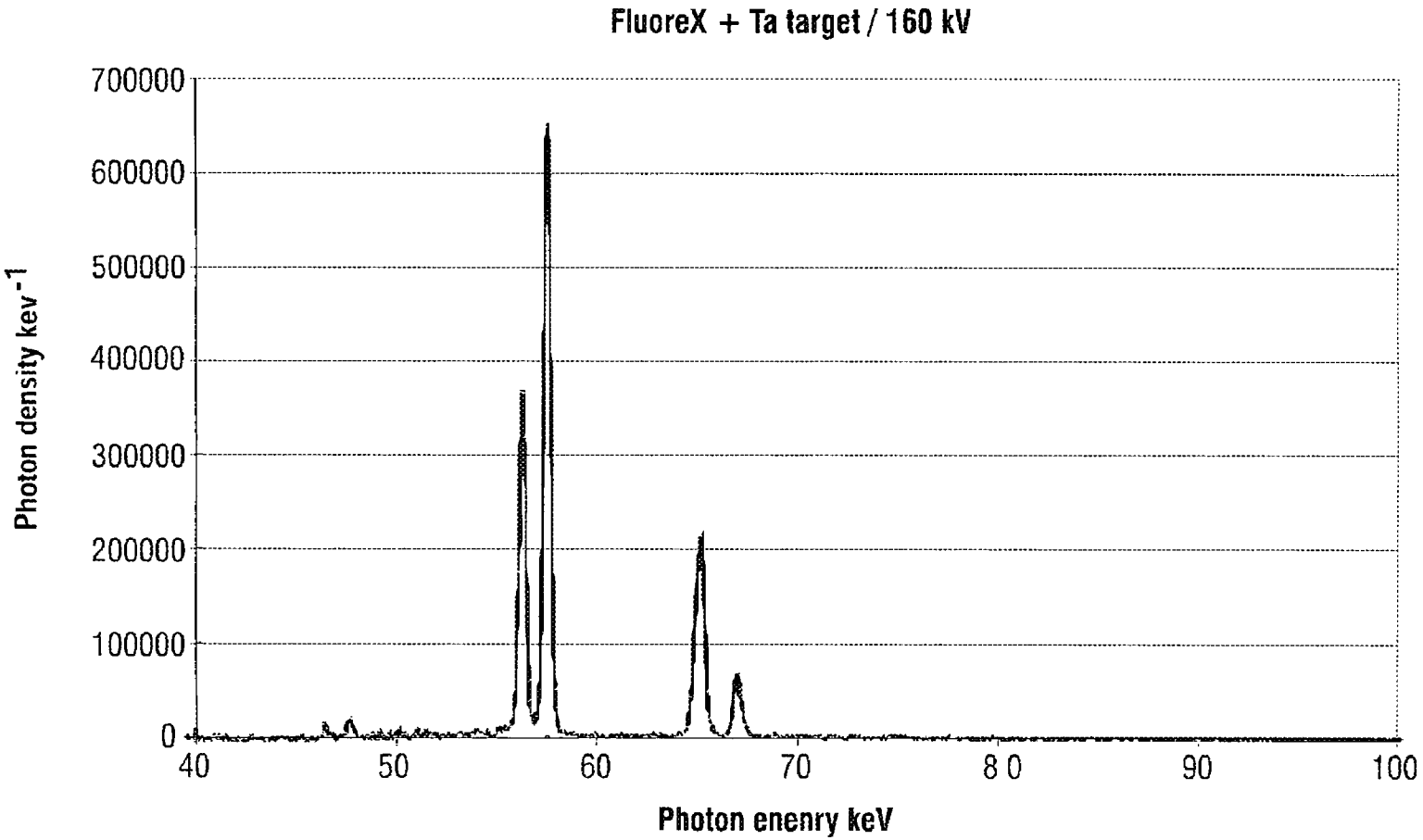
FIG. 1 shows an emission spectrum of a known Fluorex device having a Ta target.

FIG. 1 shows an emission spectrum of a known Fluorex device having a Ta target as marketed by Philips. The fluorescent radiation originates via the photoelectric effect in a secondary target (of Ta in this device) which is irradiated by a continuous X-ray spectrum whose maximum photon energy is significantly higher (a factor of 3) than the K absorption edge of the secondary target. The photon output of this device is proportional to the power of the primary X-ray beam which falls on the secondary target. A higher radiance is therefore feasible when the primary power is increased. In the Fluorex arrangement, the primary beam is emitted by a water-cooled stationary anode which limits the applied power of the electron beam to approximately 10 kW. The purpose of the present invention is to radically increase the permissible power by arranging for the electron beam to interact with a turbulently-flowing liquid metal.

Figure 2:
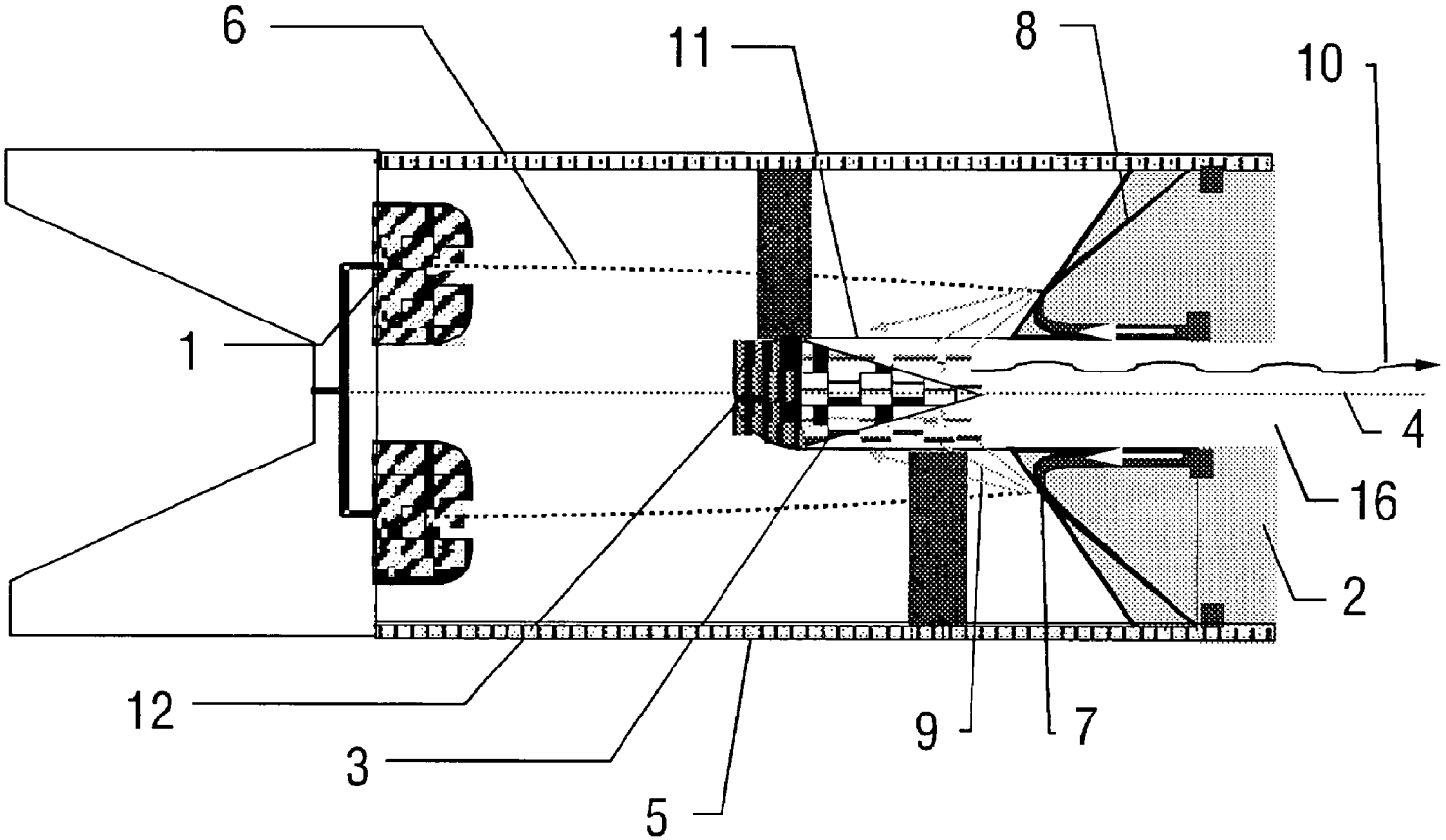
FIG. 2 shows a central cross-section through an X-ray source according to the invention.
Figure 3:
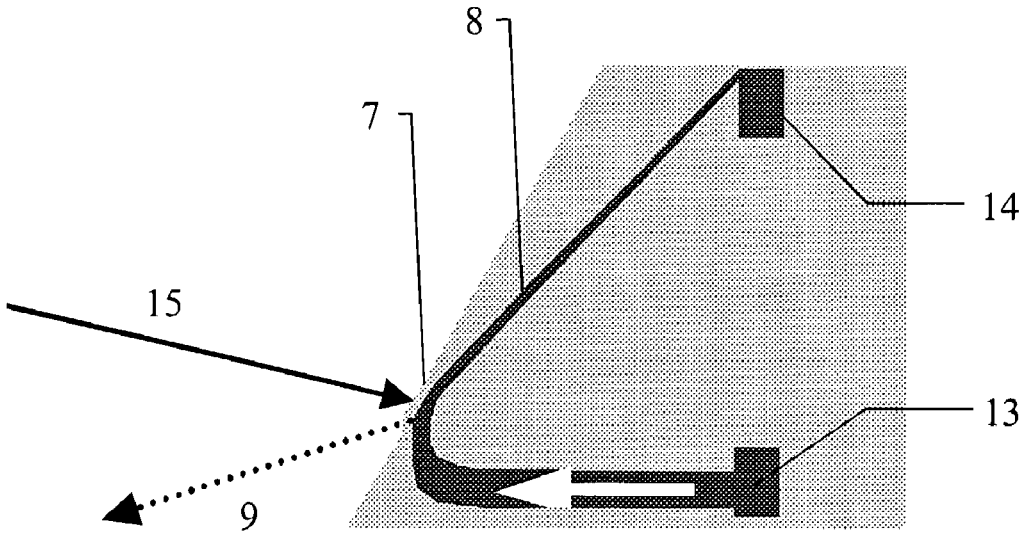
FIG. 3 shows an enlarged portion of a primary target of the X-ray source shown in FIG. 1.

A central cross-section through the arrangement of an X-ray source according to the invention is shown in FIG. 2. The arrangement essentially comprises a cathode 1 and a target (anode) having a primary target (also called end cap) 2 and a secondary target 3. The arrangement is circularly symmetric around the central (rotational) axis 4 and is located inside a housing 5. An electron beam 6 emitted from the ring cathode 1 impacts on a membrane (foil) 7 of the primary target 2. The foil 7 is of a material (e.g. W) which is sufficiently thin, in order that the electrons lose a negligible proportion of their original energy therein. The primary target 2 further comprises a liquid metal channel 8 which allows a liquid metal to circulate in radial direction relative to the central axis 4 from an inner side 13 to an outer side 14 of the ring-shaped primary target 2. FIG. 3 is an enlarged view of one half of the primary target 2 shown in FIG. 2.

The foil 7 serves the purpose of separating the vacuum region of the X-ray tube from a liquid metal behind the foil 7. The liquid metal can be an alloy of e.g. Bi, Pb, In, Sn, etc., but should at least have a high atomic number, preferably between 40 and 80. The electrons 6 diffuse into the liquid metal, thereby loosing energy which is converted into heat. As the liquid metal is moving with a speed of many meters per second, the total power which can be dissipated in the liquid metal is much larger than that of a stationary anode X-ray tube.

The direction of motion of the liquid metal can be gauged from the arrows showing the flow direction in FIG. 3. It enters the primary target 2 at a comparatively small radius and leaves it again at a comparatively large radius. Further elements such as a heat exchanger, liquid metal pump, etc. can be added to the arrangement in FIG. 2 to yield a closed circuit for the liquid metal channel 8 around which the liquid metal is repetitively circulated.

Primary X-rays 9 are generated in the electron membrane 7 and in the liquid metal 8, providing this has a relatively high Z. As shown in FIG. 2, these X-rays 9 hit the secondary target 3 through an X-ray window 11 (e.g. of Be) and excite fluorescent radiation 10. The secondary target 3 shows a cone-shaped form of a circular cross-section with a tip facing away from the cathode 1 in the direction of the central axis 4. Further, a primary beam stop 12 is provided on the side facing the cathode 1 to prevent X-rays 9 from hitting the cathode 1. The fluorescent radiation 10 leaves the X-ray tube along the direction of the central axis 4 through an exit window 16 in the primary target 2 and the housing 5. The primary target 2 is illustrated in FIG. 4 when viewed in the direction of the central axis 4.

The primary target 2 serves several purposes. First, it absorbs all the other radiation generated in the X-ray tube by the electron beam, X-ray scatter events etc. To this end the end cap has an equivalent thickness of several mm Pb. Secondly, the primary target 2 has a circular channel (inlet) 13 at a comparatively small radius, through which liquid metal is fed into the anode, and a similar channel (outlet) 14 at a comparatively large radius, through which liquid metal is transported to a pump etc. Thirdly, the primary target 2 has a form which matches with the liquid metal circuit 8 (i.e. confusor, constriction and diffusor) and supports the electron window 7.

Figure 4:
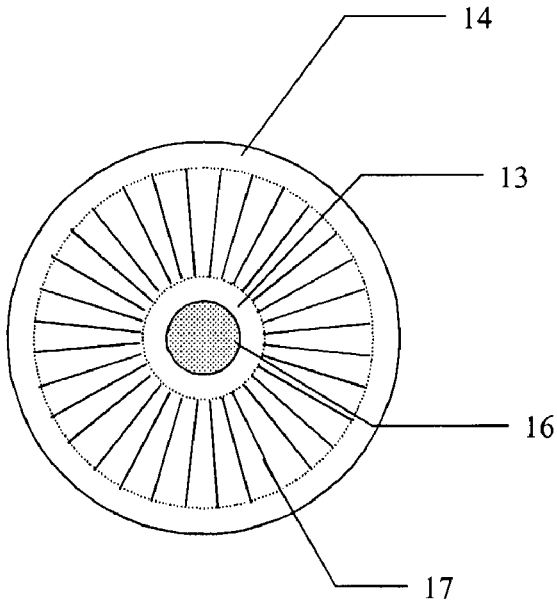
FIG. 4 shows an end surface of the primary target shown in FIG. 3 when viewed along the direction of a central axis of the X-ray source.

Finally, as is apparent from FIG. 4, the part of the primary target 2 to the left of the liquid metal channel 8 in FIG. 3 is provided with fins 17 which direct the liquid metal to move in a strictly radial sense from the inner (feed) to the outer (outlet) radius.

According to the invention the liquid metal channel 8 shows a cross-sectional area (channel height×circumference) across which the liquid flow is held constant. As the radius increases (from the inlet 13 to the outlet 14) the channel height is reduced. Radial flow of the liquid metal is ensured by the fins 17. Further, the pressure on the electron window 7 can be minimised by ensuring that the viscous pressure drop across the window 7 is balanced by an increase in the Bernoulli pressure. In the radial embodiment of the liquid channel 8 the pressure drop across the window is not linear with the radius. To achieve a minimum pressure at the electron window 7, the liquid channel comprises a constriction 15 at an electron impact zone where most or all of the electrons 6 are incident.

The present invention provides a high-brightness quasi-monochromatic X-ray source for the generation of fluorescent X-rays. It employs a liquid metal target in a circularly-symmetric flow geometry to yield a primary beam of high intensity (factor ten improvement over known Fluorex design). When this beam irradiates the exchangeable secondary target, a high intensity beam of fluorescent photons results. The enhanced radiance of this arrangement enables practical realization of otherwise unrealistic radiological techniques such as molecular imaging, tissue characterization with coherent X-ray scatter, and baggage inspection.

The invention claimed is:

1. An X-ray anode for the emission of fluorescent X-rays in response to the incidence of electrons, said anode comprising a ring-shaped primary target for the emission of primary X-rays in response to the incidence of the electrons and a secondary target for the emission of fluorescent X-rays in response to the incidence of the primary X-rays, wherein said primary target comprises a liquid metal channel arranged in a radial direction relative to a central axis, said radial direction being substantially transverse to said central axis, said central axis being substantially parallel with a direction of said emission of electrons, said liquid metal channel operable to circulate liquid metal therethrough, during operation of the X-ray source anode, in the radial direction, the liquid metal entering an inlet at an inner side of said ring-shaped primary target and leaving from an outlet at an outer side of said ring-shaped primary target, such that primary X-rays are generated in the liquid metal when struck by an electron beam, wherein the inner side is closer to the central axis than the outer side along the radial direction.

2. The X-ray anode as claimed in claim 1, wherein said secondary target is arranged on the central axis of the ring-shaped primary target and is adapted to emit the fluorescent X-rays substantially in directions parallel to said central axis.

3. An X-ray source for the generation of fluorescent X-rays comprising:

an electron source for the emission of electrons; and said X-ray anode as defined in claim 2.

4. The X-ray source as claimed in claim 3, wherein the liquid metal channel comprises a constriction in an electron impact zone in which the electrons hit the primary target.

5. The X-ray source as claimed in claim 3, wherein the surface of the primary target facing the electron source is covered by a metal membrane.

6. The X-ray anode as defined in claim 5, wherein the metal membrane includes metal foil.

7. The X-ray anode as claimed in claim 1, wherein the liquid metal comprises a material having an atomic number larger than 40.

8. An X-ray device comprising:

a primary target for the emission of primary X-rays in response to an incidence of electrons from an electron source; and a secondary target for the emission of fluorescent X-rays in response to the emission of the primary X-rays;

wherein the primary target comprises a liquid metal channel arranged in a radial direction relative to a central axis, the liquid metal channel being configured to circulate a liquid metal entering an inlet at an inner side of the primary target and leaving from an outlet at an outer side of the primary target, and wherein liquid metal channel is separated by radially aligned fins into a number of radial sub-channels.

9. The X-ray anode as claimed in claim 1, wherein said liquid metal channel is separated by radially aligned fins into a number of radial sub-channels.

10. An X-ray source for the generation of fluorescent X-rays comprising:

an electron source for the emission of electrons; and said X-ray anode as defined in claim 7.

11. The X-ray anode as defined in claim 1, wherein the liquid metal comprises a material having an atomic number in a range between 40 and 80.

12. The X-ray anode as defined in claim 1, wherein the liquid metal comprises an alloy comprising an element selected from the group consisting of Bi, Pb, In, and Sn.

13. An X-ray source for the generation of fluorescent X-rays comprising:

an electron source for the emission of electrons; and said X-ray anode as defined in claim 9.

14. The X-ray anode of claim 1, wherein the inner side is substantially near the central axis.

15. An X-ray anode for the emission of fluorescent X-rays in response to the incidence of electrons, said anode comprising a ring-shaped primary target for the emission of primary X-rays in response to the incidence of the electrons and a secondary target for the emission of fluorescent X-rays in response to the incidence of the primary X-rays, wherein said primary target comprises a liquid metal channel arranged in a radial direction relative to a central axis, said liquid metal channel operable to circulate liquid metal therethrough, during operation of the X-ray anode, in the radial direction from an inner side to an outer side of said ring-shaped primary target, such that primary X-rays are generated in the liquid metal when struck by an electron beam, and wherein said liquid metal channel is separated by radially aligned fins into a number of radial sub-channels.

16. An X-ray source for the generation of fluorescent X-rays comprising:

an electron source for the emission of electrons; and said X-ray anode as defined in claim 15.

17. An X-ray source for the generation of fluorescent X-rays comprising:

an electron source for the emission of electrons; and said X-ray anode as defined in claim 1.

18. An X-ray device comprising:

a primary target for the emission of primary X-rays in response to an incidence of electrons from an electron source; and a secondary target for the emission of fluorescent X-rays in response to the emission of the primary X-rays;

wherein the primary target comprises a liquid metal channel arranged in a radial direction relative to a central axis, the liquid metal channel being configured to circulate a liquid metal entering an inlet at an inner side of the primary target and leaving from an outlet at an outer side of the primary target, wherein the inner side is closer to the central axis than the outer side along the radial direction.

19. The X-ray device of claim 18, wherein the inner side is substantially near the central axis.

20. The X-ray device of claim 18, further comprising a primary beam stop on a side of the secondary target facing the electron source to prevent the primary X-rays from hitting the electron source.

* * * * *